US007900932B2

(12) United States Patent
Leimer et al.

(10) Patent No.: US 7,900,932 B2
(45) Date of Patent: Mar. 8, 2011

(54) VALVE STEM SEALING ASSEMBLY

(75) Inventors: Mark A. Leimer, Fort Wayne, IN (US); Mark A. Stamback, Avilla, IN (US); Cathy Stamback, legal representative, Avilla, IN (US)

(73) Assignee: Dana Automotive Systems Group, LLC, Maumee, OH (US)

( * ) Notice: Subject to any disclaimer, the term of this patent is extended or adjusted under 35 U.S.C. 154(b) by 8 days.

(21) Appl. No.: 10/910,136

(22) Filed: Aug. 3, 2004

(65) Prior Publication Data

US 2006/0027977 A1 Feb. 9, 2006

(51) Int. Cl.
*F01L 3/08* (2006.01)

(52) U.S. Cl. ..... 277/502

(58) Field of Classification Search ..... 277/502, 277/590, 634, 635; 123/188.6
See application file for complete search history.

(56) References Cited

U.S. PATENT DOCUMENTS

| | | | | | |
|---|---|---|---|---|---|
| 2,966,539 | A | * | 12/1960 | Sears et al. | 174/47 |
| 4,639,200 | A | * | 1/1987 | Baumgardner et al. | 418/48 |
| 4,834,037 | A | | 5/1989 | Lafever | |
| 4,909,202 | A | | 3/1990 | Binford et al. | |
| 4,909,202 | A | * | 3/1990 | Binford et al. | 123/188.6 |
| 5,072,950 | A | | 12/1991 | Littleproud et al. | |
| 5,553,869 | A | | 9/1996 | Stamback | |
| 5,738,358 | A | * | 4/1998 | Kalsi et al. | 277/544 |
| 5,775,284 | A | * | 7/1998 | Kirchner et al. | 123/188.6 |
| 6,120,036 | A | * | 9/2000 | Kalsi et al. | 277/559 |
| 6,205,969 | B1 | * | 3/2001 | McArthy | 123/188.6 |
| 6,209,504 | B1 | * | 4/2001 | Hegemier et al. | 123/188.6 |
| 6,227,548 | B1 | * | 5/2001 | Netzer | 277/502 |
| 6,244,235 | B1 | * | 6/2001 | Hegemier et al. | 123/188.6 |
| 6,412,467 | B1 | | 7/2002 | Leimer | |
| 6,450,143 | B1 | | 9/2002 | Hegemier et al. | |
| 6,938,877 | B2 | * | 9/2005 | McArthy et al. | 251/214 |
| 2005/0040603 | A1 | * | 2/2005 | Leimer | 277/502 |

* cited by examiner

*Primary Examiner* — Shane Bomar
*Assistant Examiner* — Gilbert Y Lee
(74) *Attorney, Agent, or Firm* — Marshall & Melhorn, LLC

(57) ABSTRACT

A valve stem seal assembly includes a retainer and a sealing element disposed within the retainer. The retainer includes upper and lower portions. The sealing element is attached to the upper portion of the retainer and includes a first sealing lip for sealing a valve stem. An optional second sealing lip may also be included.

16 Claims, 1 Drawing Sheet

VALVE STEM SEALING ASSEMBLY

TECHNICAL FIELD

The invention relates to internal combustion engine valve stem seal assemblies, and more particularly to a valve stem seal assembly that has an elastomeric valve stem seal bonded to a multi-diameter metal retainer.

BACKGROUND OF THE INVENTION

Those skilled in the art will appreciate the manner in which intake and exhaust valves are employed in cylinder heads of internal combustion engines. In conventional overhead valve internal combustion engines, a pair of valves reciprocates in timed alternation to provide intermittent communication between the intake and exhaust manifolds and a combustion chamber. As is well known, the intake port of a combustion chamber is opened and closed by the reciprocating motion of at least one intake valve. The intake valve permits fuel mixed with air to flow into the combustion chamber. In addition, an internal combustion engine has at least one exhaust valve and associated exhaust port for releasing expended combustion gases into the atmosphere. Lubrication is provided to the upper portions of the valves. Because temperatures in the combustion chamber may approach or exceed 1000 degrees Centigrade, any lubricating oil exposed to these temperatures will vaporize or burn leaving behind deposits that may interfere with the proper sealing of the valves and cause rapid deterioration. Also, excessive burned or unburned oil in the exhaust stream may worsen engine exhaust emissions. Valve stem seal assemblies are used to seal against leakage of oil between each valve guide and its associated valve stem.

It is therefore necessary to provide seals around the upper region of the valve stems and along the valve guide. A typical valve stem seal takes the form of a cylinder partially closed at one end by the valve seal. The cylindrical region seats about the valve guide to maintain the valve seal stationary. An upper region of the valve stem is surrounded by the valve seal when the valve stem is fully inserted into the valve seal assembly.

However, known constructions where the valve stem seals seat about the valve guide, require a great deal of material to extend along the height of the valve guide. Additional material translates into higher costs.

BRIEF SUMMARY OF THE INVENTION

The invention is directed to an improved valve stem seal assembly for sealing a valve stem, using minimal material, and thus being cost effective without sacrificing sealing capabilities. The valve stem seal assembly of the present invention includes a retainer and a sealing element disposed within the retainer. The retainer includes an upper portion, a lower portion and a radially extending flange. The flange is connected to the lower portion. The lower portion is connected to the upper portion by an inwardly extending step. The diameter of the upper portion is less than the diameter of the lower portion.

The sealing element is annular and constructed of an elastomeric material. The sealing element further includes at least one sealing lip that engages an upper portion of a valve guide. The sealing lip is formed by a downwardly and inwardly curving first section of the sealing member that extends from a top surface of the sealing member such that the sealing lip is spaced a predetermined distance from the top of the sealing member. The sealing lip further includes a generally planar portion that extends a predetermined length so as to provide a gripping surface. An optional second sealing lip may also be included.

DETAILED DESCRIPTION OF THE INVENTION

Figure 1:
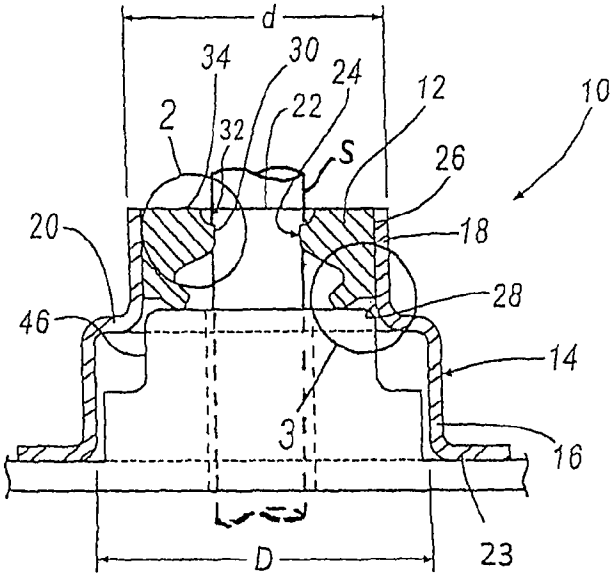
FIG. 1 is a cross section of integral bonded top seal for a valve stem in accordance with the present invention.

Referring initially to FIG. 1, a valve stem seal assembly 10 incorporates an elastomeric valve sealing element of valve stem seal 12 that is assembled to a generally cylindrical retainer 14. Sealing element 12 may be affixed to retainer 14 by bonding or the like. Although the invention contemplates that retainer 14 is formed of metal, other materials may be suitable depending on the harshness of the particular environment. For example, some glass-filed nylons or other plastics may be suitable for some engine environments, such that retainer 14 may suitably formed of plastic materials.

Retainer 14 includes a lower cylindrical portion 16 and an upper cylindrical portion 18. Upper and lower cylindrical portions 16, 18 are connected together by a step 20 that extends inwardly from lower cylindrical portion 16 such that upper cylindrical portion 18 has a diameter d that is less than the diameter D of lower cylindrical portion 16. Upper cylindrical portion 18 has an opening 22 therein. Retainer 14 further includes a radially extending flange 23 that is preferably integral with the lower cylindrical portion 16.

Figure 2:
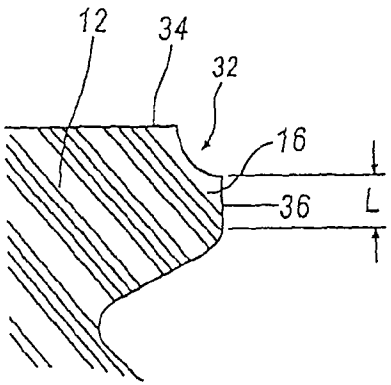
FIG. 2 is an enlarged view of a top portion of the seal taken from section 2 of FIG. 1.
Figure 3:
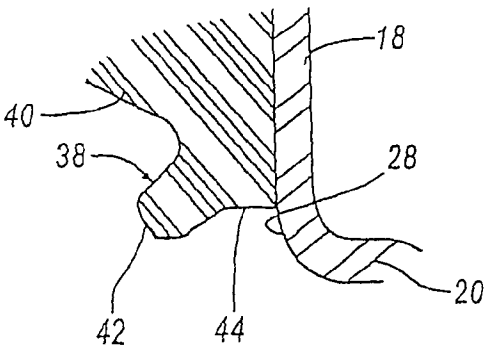
FIG. 3 is an enlarged view of a bottom portion of the seal taken from section 3 of FIG. 1.

Sealing element 12 has a generally cylindrical body that includes interior surface 24 and an exterior surface 26. Exterior surface 26 is generally planar and is attached to an interior wall 28 of upper cylindrical portion 18 of retainer 14. Interior surface 24 includes an oil sealing lip 30 that is adapted for contacting a cylindrical surface of a valve stem S. Oil sealing lip 30 is formed by a first section 32 of sealing element 12 that extends downwardly and curves inwardly toward the center of valve stem seal assembly 10. First section 32 serves to space oil sealing lip 30 a predetermined distance from the top surface 34 of sealing element 12. In addition, the curve of the first section 32 operates to create a reservoir to collect oil. Oil sealing lip 30 has a generally planar portion 36. Planar portion 36 is oriented so as to be generally vertical, as shown in FIG. 2, and has a predetermined length L, so as to provide a gripping surface for contacting the valve stem S.

Sealing element 12 may further includes a second oil sealing lip 38 that is longitudinally spaced from oil sealing lip 30 adapted to contact the valve stem S. Second oil sealing lip 38 is formed by a connecting portion 40 that extends downwardly and outwardly from first oil sealing lip 30. Second oil sealing lip 38 is spaced outwardly from oil sealing lip 30 and includes a contact surface 42 that is angled. Contact surface 42 is offset from a bottom portion 44 of exterior surface 26 of sealing element 12.

Those skilled in the art will appreciate that second oil sealing lip 38 is not required in all applications. Moreover, those skilled in the art will appreciate that oil sealing lip 30 (and second oil sealing lip 38) are sized to assure proper lubrication and consequent avoidance of premature damage to the oil sealing lip 30 (and second oil sealing lip 38) due to friction, as well as any friction scouring of the valve stem.

In accordance with one aspect of the invention, an oily environment exists above the cylinder head deck, or one subject to "splash and spray oil" as described in the art. As a result, valve stem assembly 10 is needed to assure that oil does not migrate into the area under the valve head of a valve stem and into the combustion chamber.

One known migration path that oil may travel into the combustion chamber extends between the valve stem and the sealing element 12. In accordance with the invention, oil sealing lip 30 is the primary gate for deterring oil travel along this migration path. The curved first section 32 of the sealing element 12 also serves to create a reservoir to collect and evaporate oil. Second oil scaling lip 38 may be included to prevent oil flow migration past the top surface of the valve guide 46, and down along a path between the valve stem and the valve stem seal assembly 10.

It should be understood that the aforementioned and other various alternatives to the embodiments of the invention described herein may be employed in practicing the invention. It is intended that the following claims define the scope of the invention and that the method and apparatus within the scope of these claims and their equivalents be covered thereby.

What is claimed as new and desired to be protected by Letters Patent of the United States is:

1. A valve stem seal assembly, comprising:

an annular valve seal retainer that includes upper and lower portions that are connected together by a single step;

wherein the diameter of the upper portion is less than the diameter of the lower portion;

wherein an outwardly radially extending flange is integrally connected perpendicular to the lower portion of the annular valve seal retainer; and an annular elastomeric sealing member having a first radially inwardly directed sealing lip and a second substantially radially inwardly directed sealing lip, wherein the annular elastomeric sealing member engages only a top surface of a valve guide;

wherein said sealing lips do not extend above said upper portion of said annular valve seal retainer;

wherein the annular elastomeric sealing member is bonded to an interior wall of the upper portion of the annular valve seal retainer; and wherein the first sealing lip has a generally vertical planar portion that extends a predetermined length parallel to the upper portion of the annular valve seal retainer which provides support to the vertical planar portion so as to provide a single continuous gripping surface.

2. The valve stem seal assembly of claim 1, wherein the step extends inwardly from the lower portion.

3. The valve stem seal assembly of claim 1, wherein the upper portion, lower portion and step of the annular valve seal retainer are integrally formed such that the retainer is a one-piece element.

4. The valve stem seal assembly of claim 3, wherein the retainer is formed of metal.

5. The valve stem seal assembly of claim 1, wherein the first sealing lip is formed by a first section of the sealing member extending downwardly and simultaneously curving inwardly from a top surface of the sealing member such that the first sealing lip is spaced a predetermined distance from the top of the sealing member.

6. The valve stem seal assembly of claim 1, wherein said second sealing lip is longitudinally spaced from the first sealing lip.

7. The valve stem seal assembly of claim 6, wherein the second sealing lip is connected to the first sealing lip by a connecting portion that extends downwardly and outwardly from the first sealing lip.

8. The valve stem seal assembly of claim 7, wherein the second sealing lip has a contact surface that is spaced outwardly from the first sealing lip.

9. The valve stem seal assembly of claim 8, wherein the contact surface is offset from a bottom portion of the sealing member.

10. The valve stem seal assembly of claim 8, wherein the contact surface is angled outwardly, such that the upper part of the contact surface is a diameter that is less than the diameter of a bottom part of the contact surface.

11. A valve stem seal assembly, comprising:

a metal annular valve seal retainer that includes upper and lower portions that are connected together by a single step;

wherein the step extends inwardly from the lower portion of the metal annular valve seal retainer such that the diameter of the upper portion is less than the diameter of the lower portion;

wherein an outwardly radially extending flange is integrally connected perpendicular to the lower portion of the annular valve seal retainer; and an annular elastomeric sealing member having first and second sealing lips that both extend in the same general radial inward direction, wherein said annular elastomeric sealing member engages only a top surface of a valve guide, and wherein said sealing lips do not extend above said upper portion of said annular valve seal retainer;

wherein the first sealing lip is formed by a first section of the sealing member extending downwardly and simultaneously curving inwardly from a top surface of the sealing member such that the sealing lip is spaced a predetermined distance from the top of the sealing member;

wherein the annular elastomeric sealing member is attached to an interior wall of the upper portion of the annular valve seal retainer; and wherein the first sealing lip has a generally planar portion that extends a predetermined length parallel to the upper portion of the annular valve seal retainer which provides support to the vertical planar portion so as to provide a single continuous gripping surface.

12. The valve stem seal assembly of claim 11, wherein the second sealing lip is connected to the first sealing lip by a connecting portion that extends downwardly and outwardly from the first sealing lip.

13. The valve stem seal assembly of claim 11, wherein the second sealing lip has a contact surface that is spaced outwardly from the first sealing lip.

14. The valve stem seal assembly of claim 13, wherein the contact surface is offset from a bottom portion of the sealing member.

15. The valve stem seal assembly of claim 13, wherein the contact surface is angled outwardly, such that the upper part of the contact surface is a diameter that is less than the diameter of a bottom part of the contact surface.

16. The valve stem seal assembly of claim 15, wherein the seal member is bonded to the retainer.

* * * * *